US006978948B2

(12) United States Patent
Heinecke

(10) Patent No.: US 6,978,948 B2
(45) Date of Patent: Dec. 27, 2005

(54) FUEL INJECTION VALVE FOR INTERNAL COMBUSTION ENGINES

(75) Inventor: Ralf Heinecke, Freiberg (DE)

(73) Assignee: Robert Bosch GmbH, Stuttgart (DE)

( * ) Notice: Subject to any disclaimer, the term of this patent is extended or adjusted under 35 U.S.C. 154(b) by 151 days.

(21) Appl. No.: 10/362,884

(22) PCT Filed: Apr. 24, 2002

(86) PCT No.: PCT/DE02/01499

§ 371 (c)(1),
(2), (4) Date: Aug. 8, 2003

(87) PCT Pub. No.: WO03/004867

PCT Pub. Date: Jan. 16, 2003

(65) Prior Publication Data

US 2004/0011890 A1 Jan. 22, 2004

(30) Foreign Application Priority Data

Jul. 4, 2001 (DE) ..... 101 32 449

(51) Int. Cl.[7] ..... F02M 61/00
(52) U.S. Cl. ..... 239/533.12; 239/533.2; 239/601; 239/597; 239/598; 239/599
(58) Field of Search ..... 239/533.12, 533.2, 239/601, 533.4, 597, 598, 599, 33.3; 123/298, 123/445, 305, 597, 276, 262

(56) References Cited

U.S. PATENT DOCUMENTS

| | | | | |
|---|---|---|---|---|
| 4,069,978 | A * | 1/1978 | El Moussa | 239/533.2 |
| 4,313,407 | A * | 2/1982 | Muller | 123/276 |
| 5,016,820 | A * | 5/1991 | Gaskell | 239/533.12 |
| 6,520,145 | B2 * | 2/2003 | Hunkert | 123/305 |
| 6,644,565 | B2 * | 11/2003 | Hockenberger | 239/533.2 |

FOREIGN PATENT DOCUMENTS

| | | |
|---|---|---|
| DE | 19815918 | * 10/1999 |
| JP | 9-126096 | * 5/1997 |

* cited by examiner

*Primary Examiner*—Dinh Q. Nguyen
(74) *Attorney, Agent, or Firm*—Ronald E. Greigg

(57) ABSTRACT

A fuel injection valve for internal combustion engines, has a valve body with a pressure chamber that can be filled with fuel under pressure. Embodied in the valve body is at least one injection conduit, which originates at the wall of the pressure chamber, where it forms an injection opening; the injection conduit connects the pressure chamber with the combustion chamber of the engine. By means of a valve needle, the injection opening can be closed or opened. The injection opening of the injection conduit has a cross section in the form of an oblong slot, so that the injection of the fuel into the combustion chamber is optimized.

3 Claims, 2 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 02/01499 filed on Apr. 24, 2002.

BACKGROUND OF THE INVENTION

1. Field of the Invention

The invention is directed to an improved fuel injection valve for internal combustion engines.

2. Description of the Prior Art

One fuel injection valve of the type with which this invention is concerned is known from German Patent Disclosure DE 199 01 057 A1, for instance, and has a valve body having a pressure chamber that can be filled with fuel under pressure. At a valve seat embodied in the pressure chamber, at least one injection conduit is embodied, which connects the pressure chamber with the combustion chamber of the engine. A valve needle disposed in the pressure chamber has a sealing face cooperating with the valve seat to open and close the opening of the injection conduit. If the fuel flows out of the pressure chamber to the injection conduit, the pressure in the pressure chamber is converted into kinetic energy by the small cross section of the injection conduit, resulting in a very fast fuel flow in the injection conduit, so that the fuel upon emerging into the combustion chamber is finely atomized, which contributes to good, clean combustion. The injection conduit is embodied in the form of a straight cylinder and has both a circular injection opening and a circular outlet opening. Because the cross section of the injection conduit is constant over the entire length, the conversion of the pressure into speed takes place solely at the injection opening of the injection conduit, so that relatively high flow losses occur there.

Conical injection conduits of a fuel injection valve are also known from European Patent Disclosure EP 0 352 926 B2, and in them the injection opening and outlet opening are circular, but the injection opening has a markedly larger diameter than the outlet opening. Preferably a plurality of injection conduits are distributed over the circumference of the fuel injection valve. However, these injection conduits have the disadvantage that if the injection opening increases in size, the web width between the injection openings must be reduced, which leads to a reduction in the stability of the valve seat and thus may cause material failure in this region because of the valve needle, which in the closing motion strikes the valve seat at high speed and thus exerts major forces on the valve seat.

SUMMARY OF THE INVENTION

The fuel injection valve of the invention has the advantage over the prior art that the conversion of pressure into speed does not occur solely at the inlet cross section of the injection conduit, but along the injection conduit as well, and that at the same time, the cross section of the injection opening of the injection conduit can be changed without requiring a change in the web width between the injection openings of the injection conduits. To that end, the injection opening of the injection conduit, which is disposed at the wall of the pressure chamber, is embodied as an oblong slot. A change in the cross section of the injection opening is thus already possible as a result of the fact that the longitudinal extent of the oblong slot is increased while the width is maintained unchanged.

In one advantageous feature of the subject of the invention, the outlet opening of the injection conduit is embodied as circular on the outside of the valve body. As a result, in a geometrically simple form, a uniform reduction in the cross section of the injection conduit from the inlet cross section to the outlet cross section is obtained.

In another advantageous feature, the injection conduit has a straight wall, by which the oblong slot-shaped injection opening communicates with the circular outlet opening. An injection conduit of this kind can be produced in a simple way, since standard known methods, such as electrochemical machining or producing the injection conduit by means of laser treatment, can be employed.

In another advantageous feature of the invention, the pressure chamber is embodied between the valve needle and the wall of a bore embodied in the valve body; the longitudinal axis of the oblong slot is oriented at least approximately in the direction of the center axis of the bore. The cross section of the injection opening is thus well adapted to the inflow conditions, since upon flowing into the injection conduit, the fuel does not have to follow along with such a major change of direction.

BRIEF DESCRIPTION OF THE DRAWINGS

Further advantages and advantageous features of the invention can be learned from the detailed description contained herein below, taken in conjunction with the drawings, in which.

DESCRIPTION OF THE PREFERRED EMBODIMENTS

Figure 1:
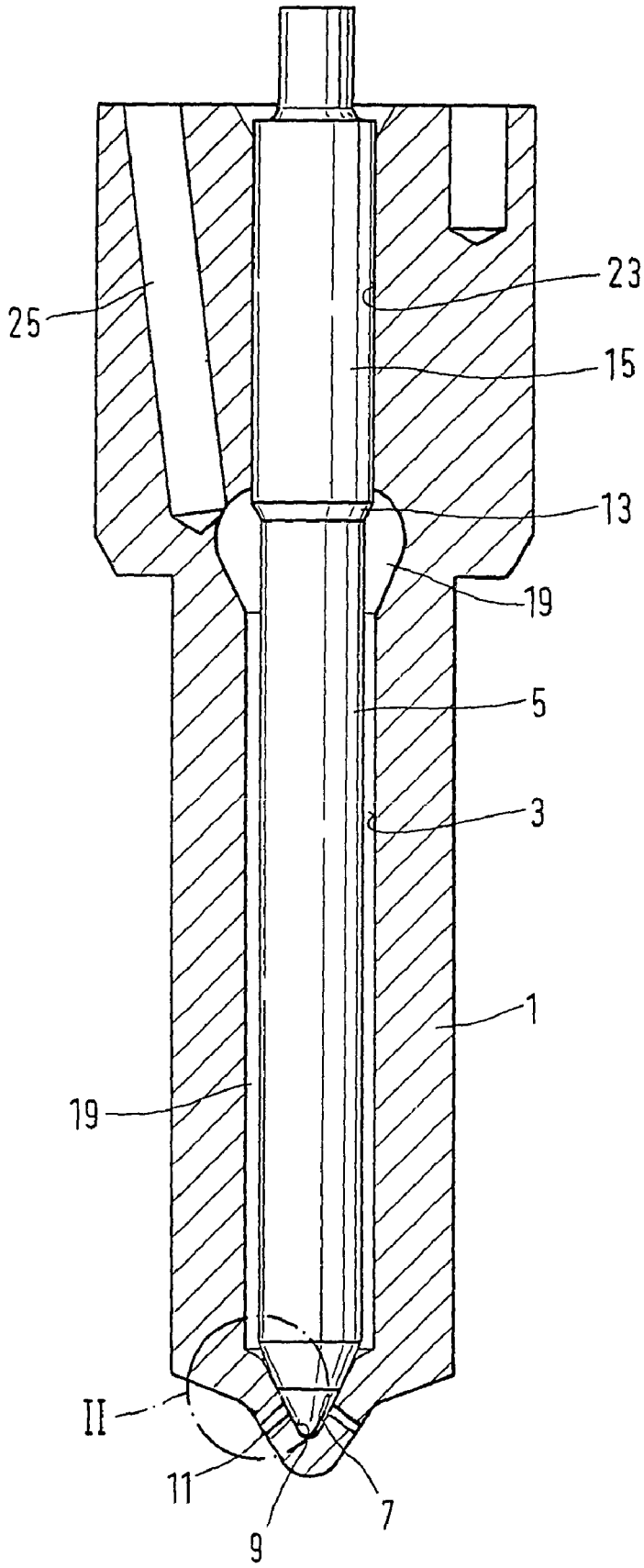
FIG. 1 is a longitudinal section through a fuel injection valve embodying the invention.

In FIG. 1, a longitudinal section is shown through a fuel injection valve of the invention, showing only the part essential for explaining the invention. A valve body 1 has a bore 3, which on its end toward the combustion chamber has a substantially conical valve seat 9. A valve needle 5 which is embodied in pistonlike fashion is disposed in the bore 3 and is guided with a portion 15, remote from the combustion chamber, in a guide portion 23 of the bore 3. The valve needle 5 tapers toward the combustion chamber, forming a pressure shoulder 13, and on its end toward the combustion chamber, it changes over into a substantially conical valve sealing face 7, which cooperates with the valve seat 9. At least one injection conduit 11 is embodied in the wall of the valve seat 9 and connects the valve seat 9 with the combustion chamber of the engine. It may be provided here that many injection conduits 11 be distributed over the circumference of the valve seat 9. The space between the valve needle 5 and the wall of the bore 3 is embodied as a pressure chamber 19, which is enlarged by means of a radial widening of the bore 3 at the level of the pressure shoulder 13, so that an inflow conduit 25 embodied in the valve body 1 can discharge into the pressure chamber 19 at a favorable angle. By way of this inlet conduit 25, the pressure chamber 19 can be filled with fuel at high pressure.

In the fuel injection valve, a device not shown in the drawing is provided, by which a closing force is exerted on the valve member 5 in the direction of the valve seat 9, the device for instance being in the form of a spring. This closing force brings the valve member 5 with the valve sealing face 7 into contact with the valve seat 9, so that the injection openings or conduits 11 are closed off from the pressure chamber 19. At the same time, because of the hydraulic pressure of the fuel, which is introduced into the pressure chamber 19 via the inflow conduit 25, a hydraulic force is created on the pressure shoulder 13, which is oriented counter to this closing force on the valve needle 5. By way of the ratio of this hydraulic opening force on the pressure shoulder 13 and the closing force on the valve needle 5, the valve needle 5 can be moved longitudinally, so that the valve sealing face 7 lifts from the valve seat 9 and opens the injection conduits 11, or with the motion in the reverse direction closes them again.

Figure 2:
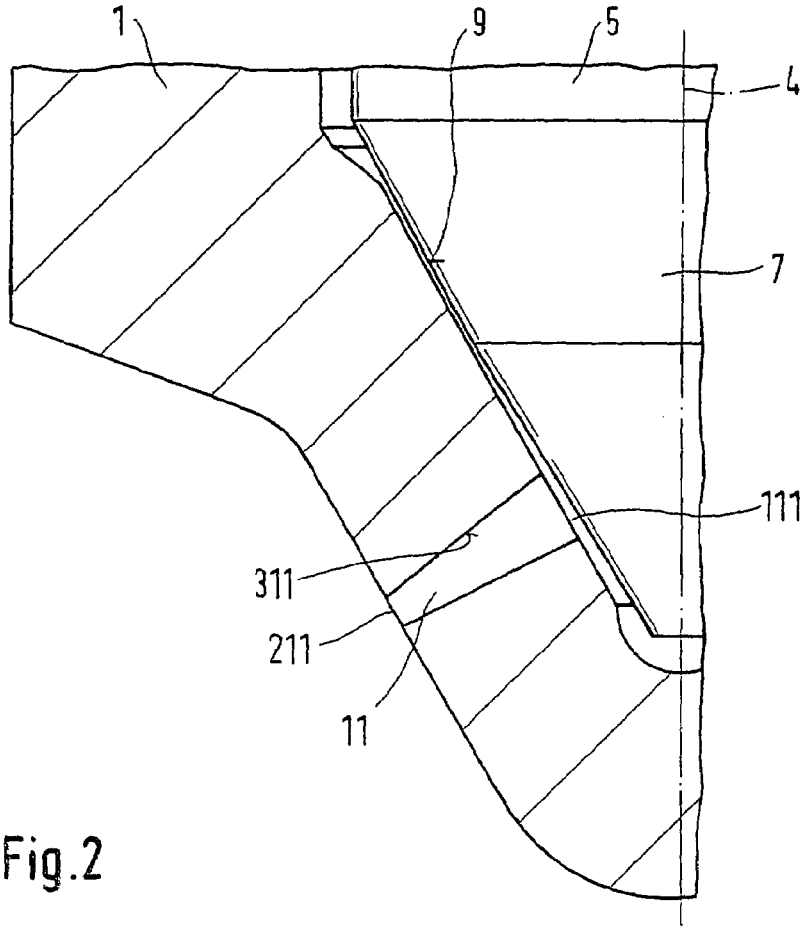
FIG. 2 is an enlargement of FIG. 1 in the detail marked II.

In FIG. 2, an enlargement of the detail marked II in FIG. 1 is shown. The injection opening or conduit 11 has one inlet or injection opening 111 and one outlet opening 211. In the longitudinal section shown, the wall 311 of the injection conduit 11 narrows from the injection opening 111 to the outlet opening 211, and the wall 311 of the injection conduit 11 is straight.

Figure 3:
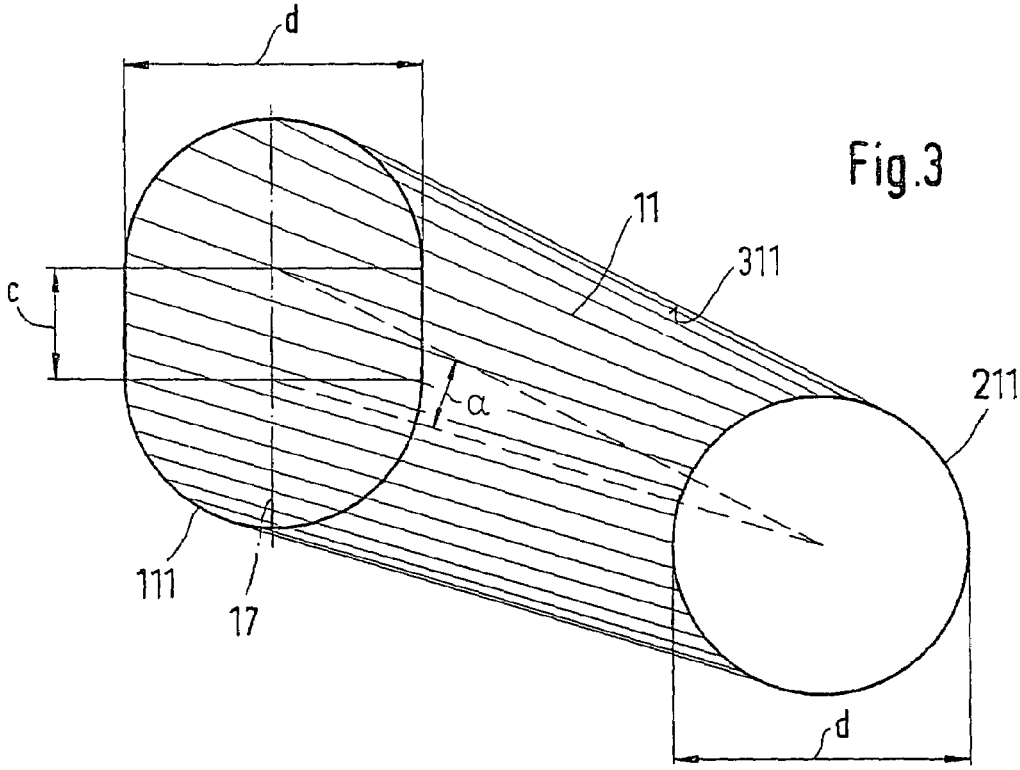
FIG. 3 is an enlarged view of the injection conduit.

FIG. 3 shows a view of the injection conduit 11 together with some geometrical variables. The injection opening 111 has the shape of an oblong slot and has a longitudinal axis 17, which represents the axis of symmetry in the longitudinal direction of the oblong slot. The oblong slot here comprises two semicircles, which have a diameter d, plus a center portion, which has a length c and which connects the semicircles together. The length c is accordingly equal to the spacing of the centers of the two semicircles. The opposite sides from one another of the center portion are straight and parallel to one another. The outlet opening 211 is embodied as circular; the injection conduit 11 is formed by a straight wall 311, which connects the injection opening ill with the outlet opening 211. If the center point of the outlet opening 211 is connected to the two center points of the semicircles of the oblong slot forming the injection opening 111, these two lines form an angle $\alpha$, which can be varied depending on the length of the portion c and on the length of the injection conduit 11. Typical dimensions of the oblong slot are a diameter d of the two semicircles of 0.15 mm to 0.17 mm, and a spacing of the centers of the semicircles c of 0.025 mm to 0.045 mm. The diameter of the outlet opening 211 is identical to the diameter of the semicircles of the oblong slot that forms the injection opening 111. The resultant angles alpha for these dimensions is in the range from 1.4° to 2.6°.

The orientation of the oblong slot that forms the injection opening 111 is such, in the present exemplary embodiment, that the longitudinal axis 17 and the center axis 4 of the bore 3 define a plane, or in other words the oblong slot is oriented in the direction of the center axis 4. Alternatively, it can be provided that the longitudinal axis 17 of the oblong slot is tilted somewhat relative to the center axis 4 of the bore 3, for instance in order to take into account a fuel ring flow in the region of the valve seat 9, which leads to better inflow of the fuel into the injection conduit 11.

Moreover, it can be provided that the outlet cross section of the injection conduit 11 also be designed as an oblong slot. For that purpose, while the cross section of the injection conduit 11 decreases from the injection opening to the outlet opening, the centers of the semicircles at the outlet opening do not coincide. It can also be provided that the longitudinal axes 17 of the injection opening and outlet opening are not parallel to one another but instead are tilted, creating a swirl in the fuel as it flows through the injection conduit 11.

The foregoing relates to preferred exemplary embodiments of the invention, it being understood that other variants and embodiments thereof are possible within the spirit and scope of the invention, the latter being defined by the appended claims.

I claim:

1. A fuel injection valve for internal combustion engines, comprising a valve body (1) in which a pressure chamber (19) that can be filled with fuel under pressure is embodied, at least one injection conduit (11) embodied in the valve body (1), the injection conduit originating at the wall of the pressure chamber (19), where it forms an injection opening (111), the injection conduit (11) connecting the pressure chamber (19) to the combustion chamber of the engine, a valve needle (5) which opens and closes the injection opening (111), and the injection opening (111) of the injection conduit (11) having a cross section in the form of an oblong slot, wherein the injection conduit (11), on its end opposite the injection opening (111), forms an outlet opening, which is embodied as circular.

2. The fuel injection valve of claim 1, wherein the injection conduit (11) comprises a straight wall (311), by which the oblong slot-shaped injection opening (111) communicates with the circular outlet opening (211).

3. The fuel injection valve of claim 1, wherein the pressure chamber (19) is embodied between a bore (3), disposed in the valve body (1), and the valve needle (5), and wherein the bore (3) has a center axis (4), which is oriented at least approximately in the direction of the longitudinal axis (17) of the oblong slot-shaped injection opening (111).

* * * * *